US009370225B1

(12) United States Patent
Lin

(10) Patent No.: US 9,370,225 B1
(45) Date of Patent: Jun. 21, 2016

(54) ZIPPER HEAD ASSEMBLY STRUCTURE FOR INCREASING TORSIONAL STRENGTH AND SLIDING MEMBER THEREOF

(71) Applicant: CHUNG CHWAN ENTERPRISE CO., LTD., Taoyuan (TW)

(72) Inventor: Yu-Pau Lin, Taoyuan (TW)

(73) Assignee: CHUNG CHWAN ENTERPRISE CO., LTD., Taoyuan (TW)

( * ) Notice: Subject to any disclaimer, the term of this patent is extended or adjusted under 35 U.S.C. 154(b) by 0 days.

(21) Appl. No.: 14/701,557

(22) Filed: May 1, 2015

(30) Foreign Application Priority Data

Mar. 13, 2015 (TW) ..... 104108084 A

(51) Int. Cl.
*A44B 19/00* (2006.01)
*A44B 19/26* (2006.01)

(52) U.S. Cl.
CPC ..... *A44B 19/262* (2013.01); *A44B 19/26* (2013.01)

(58) Field of Classification Search
CPC ..... Y10T 24/2571; Y10T 24/2577; Y10T 24/2586; Y10T 24/257; Y10T 24/2598; Y10T 24/2561; Y10T 24/2568; Y10T 24/2573; Y10T 24/2584; Y10T 24/2588; Y10T 29/49945; A44B 19/308; A44B 19/306; A44B 19/26; A44B 19/262; A44B 19/30; A44B 19/305; A44B 19/42
See application file for complete search history.

(56) References Cited

U.S. PATENT DOCUMENTS 3,320,645 A * 5/1967 Burbank ..... A44B 19/30 24/421
3,813,736 A * 6/1974 Fukuroi ..... A44B 19/308 24/424
4,069,556 A * 1/1978 Takahashi ..... A44B 19/306 24/421
4,271,567 A * 6/1981 Aoki ..... A44B 19/306 24/421
4,287,646 A * 9/1981 Kanzaka ..... A44B 19/308 24/424
5,568,674 A * 10/1996 Harada ..... A44B 19/26 24/419
5,664,300 A * 9/1997 Mizuno ..... A44B 19/308 24/421
5,694,667 A * 12/1997 Mizuno ..... A44B 19/306 24/421

(Continued)

*Primary Examiner* — Robert J Sandy
*Assistant Examiner* — David Upchurch
(74) *Attorney, Agent, or Firm* — Li & Cai Intellectual Property (USA) Office

(57) ABSTRACT

A zipper head assembly structure for increasing torsional strength includes a sliding member, a locking hook member, a pull member, a cap body, and an elastic member. The sliding member has a first sliding portion, a second sliding portion, and a connection portion connected between the first and the second sliding portions. The first sliding portion has a first support body and a second support body. The first sliding portion has an arc-shaped outer surface concaved downwardly from an upper side thereof. The locking hook member is movably disposed on the first and the second support bodies. The pull member has a pivot portion movably disposed between the locking hook member and the arc-shaped outer surface. The cap body is disposed on the first and the second support bodies. The elastic member is disposed between the inner surface of the cap body and the locking hook member.

10 Claims, 9 Drawing Sheets

(56) References Cited

U.S. PATENT DOCUMENTS 5,729,874 A * 3/1998 Mizuno ..... A44B 19/308 24/429
6,993,810 B2 * 2/2006 Hamada ..... A44B 19/308 24/422
7,219,401 B2 * 5/2007 Yamagishi ..... A44B 19/306 24/421
7,257,869 B2 * 8/2007 Lin ..... A44B 19/262 24/421
7,650,674 B2 * 1/2010 Miyazaki ..... A44B 19/308 24/424
2003/0182774 A1 * 10/2003 Lin ..... A44B 19/305 24/436
2007/0169321 A1 * 7/2007 Lin ..... A44B 19/308 24/421
2009/0313793 A1 * 12/2009 Lin ..... A44B 19/26 24/429
2012/0291236 A1 * 11/2012 Lin ..... A44B 19/26 24/429
2012/0297584 A1 * 11/2012 Lin ..... A44B 19/306 24/429
2013/0318751 A1 * 12/2013 Lin ..... A44B 19/42 24/429

* cited by examiner

ZIPPER HEAD ASSEMBLY STRUCTURE FOR INCREASING TORSIONAL STRENGTH AND SLIDING MEMBER THEREOF

BACKGROUND OF THE INVENTION

1. Field of the Invention

The instant disclosure relates to a zipper head assembly structure and a sliding member thereof, and more particularly to a zipper head assembly structure and a sliding member thereof for increasing torsional strength due to an enlarged pivot portion of a pull member of the sliding member.

2. Description of Related Art

In general, zippers are basic elements in clothing or accessories. Compared to buttons, the zippers are easier to use. A conventional zipper comprises a zipper head and a tape. The zipper head works with the tape to allow the pulling action. Recently, the zipper has been commonly used for clothing, pants, backpack, and other accessories.

A traditional zipper head assembly structure comprises a fastening slider, a pulling piece, a horse-like hook and a cap. The above components of the conventional zipper head assembly structure are assembled using the following procedure. One end portion of the pulling piece is positioned into a recessed space of the fastening slider. The pulling piece is pushed toward one end of the fastening slider, so that a first fixing base or a second fixing base of the fastening slider can be put around a hole of the pulling piece. Then, the horse-like hook is fixed to the first fixing base and the second fixing base of the fastening slider. The head portion of the horse-like hook is positioned in a groove of the first fixing base, while the tail portion of the horse-like hook is positioned to abut against the bottom of the groove of the second fixing base. The abdominal portion of the horse-like hook is supported on the end portion of the pulling piece. The stop portion of the horse-like hook extends into a sliding groove of the fastening slider via a horse-like hook hole between the first fixing base and the second fixing base. Finally, the cap is used to cover on the first fixing base and the second fixing base of the fastening slider. An elastic piece is inserted into the interior of the cap for abutting on the horse-like hook.

SUMMARY OF THE INVENTION

One aspect of the instant disclosure relates to a zipper head assembly structure and a sliding member thereof for increasing torsional strength.

One of the embodiments of the instant disclosure provides a zipper head assembly structure for increasing torsional strength, comprising: a sliding member, a locking hook member, a pull member, a cap body, and an elastic member. The sliding member has a first sliding portion, a second sliding portion corresponding to the first sliding portion, and a connection portion connected between the first sliding portion and the second sliding portion, wherein a first receiving space is formed between the first sliding portion and the second sliding portion, the first sliding portion has a first support body and a second support body corresponding to the first support body, the first support body has a hook groove, and the second support body has a hook hole communicated with the first receiving space. The locking hook member is movably disposed on the first support body and the second support body, wherein the locking hook member has a first end portion disposed inside the hook groove, a second end portion passing through the hook hole, and a contact portion connected between the first end portion and the second end portion. The pull member has a pivot portion disposed on an end side thereof, wherein the pivot portion of the pull member is movably disposed between the locking hook member and the first sliding portion. The cap body has a first side portion disposed on the first support body and a second side portion opposite to the first side portion and disposed on the second support body. The elastic member is disposed between the inner surface of the cap body and the locking hook member.

More particularly, the first sliding portion has an arc-shaped outer surface concaved downwardly from an upper side thereof, a second receiving space is formed between the contact portion of the locking hook member and the arc-shaped outer surface of the first sliding portion, and the pivot portion of the pull member is received inside the second receiving space. The first sliding portion has a first left side wall portion, a left side reinforced rib connected to the first left side wall portion, a first right side wall portion corresponding to the first left side wall portion, and a right side reinforced rib connected to the first right side wall portion and corresponding to the left side reinforced rib, the first left side wall portion and the left side reinforced rib are extended along a first predetermined direction from a first side of the first sliding portion to the second sliding portion, and the first right side wall portion and the right side reinforced rib are extended along a second predetermined direction from a second side of the first sliding portion to the second sliding portion. The second sliding portion has a second left side wall portion facing the first left side wall portion, a left side inclined surface connected to the second left side wall portion and facing the left side reinforced rib, a second right side wall portion facing the first right side wall portion and corresponding to the second left side wall portion, and a right side inclined surface connected to the second right side wall portion and facing to the right side reinforced rib, the second left side wall portion is extended along a third predetermined direction from a first side of the second sliding portion to the first sliding portion, and the second right side wall portion is extended along a fourth predetermined direction from a second side of the second sliding portion to the first sliding portion.

Another one of the embodiments of the instant disclosure provides a zipper head assembly structure for increasing torsional strength, comprising: a sliding member, a locking hook member, a pull member, a cap body, and an elastic member. The sliding member has a first sliding portion, a second sliding portion corresponding to the first sliding portion, and a connection portion connected between the first sliding portion and the second sliding portion, wherein the first sliding portion has a first support body and a second support body corresponding to the first support body, and the first sliding portion has an arc-shaped outer surface concaved downwardly from an upper side thereof. The locking hook member is movably disposed on the first support body and the second support body. The pull member has a pivot portion disposed on an end side thereof, wherein the pivot portion of the pull member is movably disposed between the locking hook member and the arc-shaped outer surface of the first sliding portion. The cap body is disposed on the first support body and the second support body to cover the locking hook member. The elastic member is disposed between the inner surface of the cap body and the locking hook member.

More particularly, the first sliding portion has a first left side wall portion, a left side reinforced rib connected to the first left side wall portion, a first right side wall portion corresponding to the first left side wall portion, and a right side reinforced rib connected to the first right side wall portion and corresponding to the left side reinforced rib, the first left side wall portion and the left side reinforced rib are extended along a first predetermined direction from a first side of the first sliding portion to the second sliding portion, and the first right side wall portion and the right side reinforced rib are extended along a second predetermined direction from a second side of the first sliding portion to the second sliding portion.

Yet another one of the embodiments of the instant disclosure provides a sliding member, comprising: a first sliding portion, a second sliding portion, and a connection portion. The second sliding portion corresponds to the first sliding portion. The connection portion is connected between the first sliding portion and the second sliding portion, wherein the first sliding portion has a first support body and a second support body corresponding to the first support body, and the first sliding portion has an arc-shaped outer surface concaved downwardly from an upper side thereof. More particularly, the first sliding portion has a first left side wall portion, a left side reinforced rib connected to the first left side wall portion, a first right side wall portion corresponding to the first left side wall portion, and a right side reinforced rib connected to the first right side wall portion and corresponding to the left side reinforced rib, the first left side wall portion and the left side reinforced rib are extended along a first predetermined direction from a first side of the first sliding portion to the second sliding portion, and the first right side wall portion and the right side reinforced rib are extended along a second predetermined direction from a second side of the first sliding portion to the second sliding portion.

Therefore, the second receiving space is increased due to the design of the arc-shaped outer surface that is concaved downwardly from the upper side of the first sliding portion, such that the size (such as diameter) of the pivot portion of the pull member is enlarged for increasing the torsional strength of the pull member. Hence, the pull member can pass a strict torsion test due to the increased torsional strength of the pull member.

To further understand the techniques, means and effects of the instant disclosure applied for achieving the prescribed objectives, the following detailed descriptions and appended drawings are hereby referred to, such that, and through which, the purposes, features and aspects of the instant disclosure can be thoroughly and concretely appreciated. However, the appended drawings are provided solely for reference and illustration, without any intention to limit the instant disclosure.

DETAILED DESCRIPTION OF THE PREFERRED EMBODIMENTS

Figure 1:
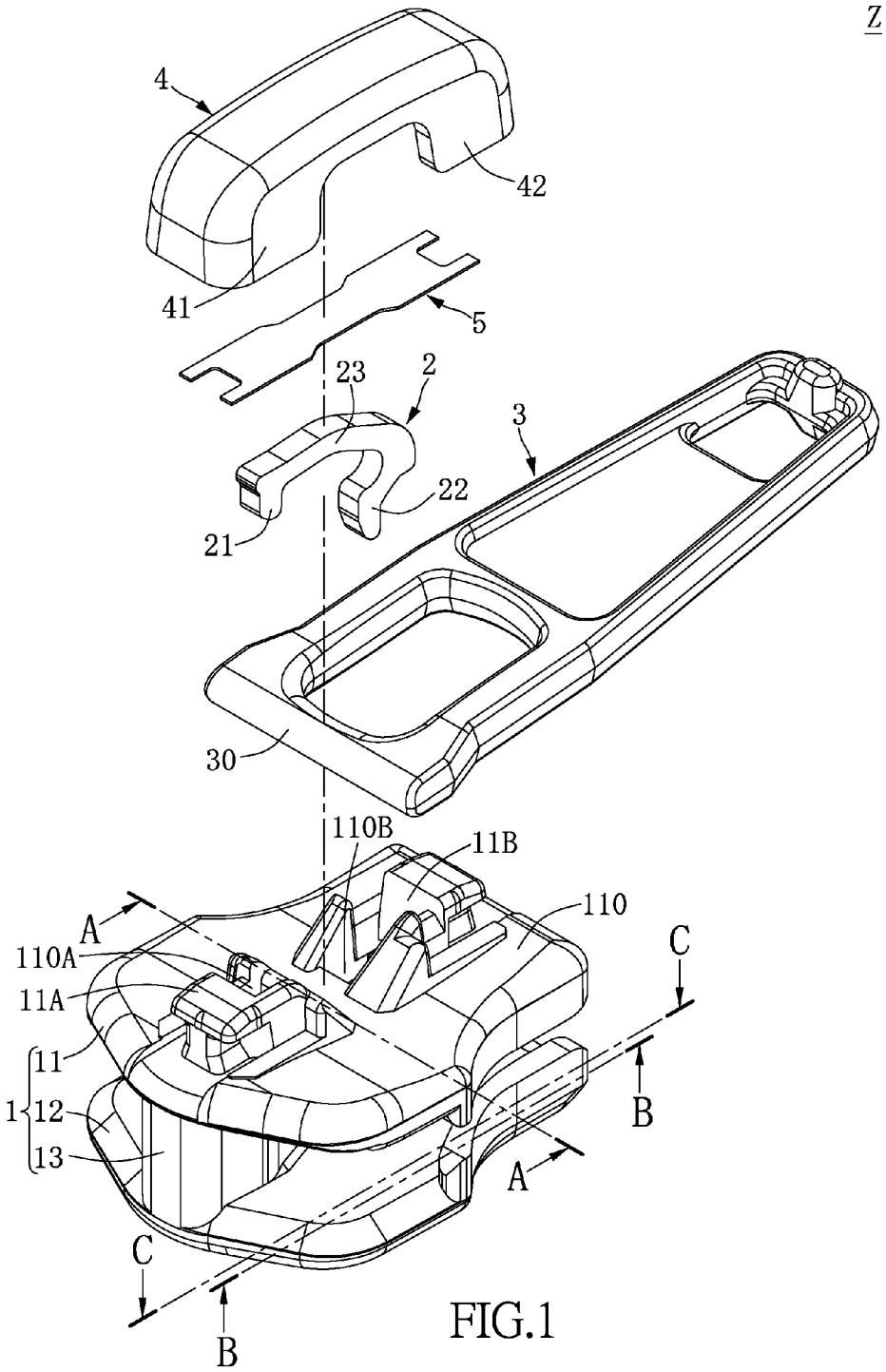
FIG. 1 shows a perspective, exploded, schematic view of the zipper head assembly structure for increasing torsional strength according the instant disclosure.

The embodiments of "a zipper head assembly structure for increasing torsional strength and a sliding member thereof" of the instant disclosure are described. Other advantages and objectives of the instant disclosure can be easily understood by one skilled in the art from the disclosure. The instant disclosure can be applied in different embodiments. Various modifications and variations can be made to various details in the description for different applications without departing from the scope of the instant disclosure. The drawings of the instant disclosure are provided only for simple illustrations, but are not drawn to scale and do not reflect the actual relative dimensions. The following embodiments are provided to describe in detail the concept of the instant disclosure, and are not intended to limit the scope thereof in any way.

Referring to FIG. 1 to FIG. 9, the instant disclosure provides a zipper head assembly structure Z for increasing torsional strength, comprising: a sliding member 1 (such as a sliding head, or a slide fastener head), a locking hook member 2 (such as a hook body or a horse-like hook), a pull member 3 (such as a pull tab or a pull piece), a cap body 4, and an elastic member 5 (such as a flat spring).

Figure 3:
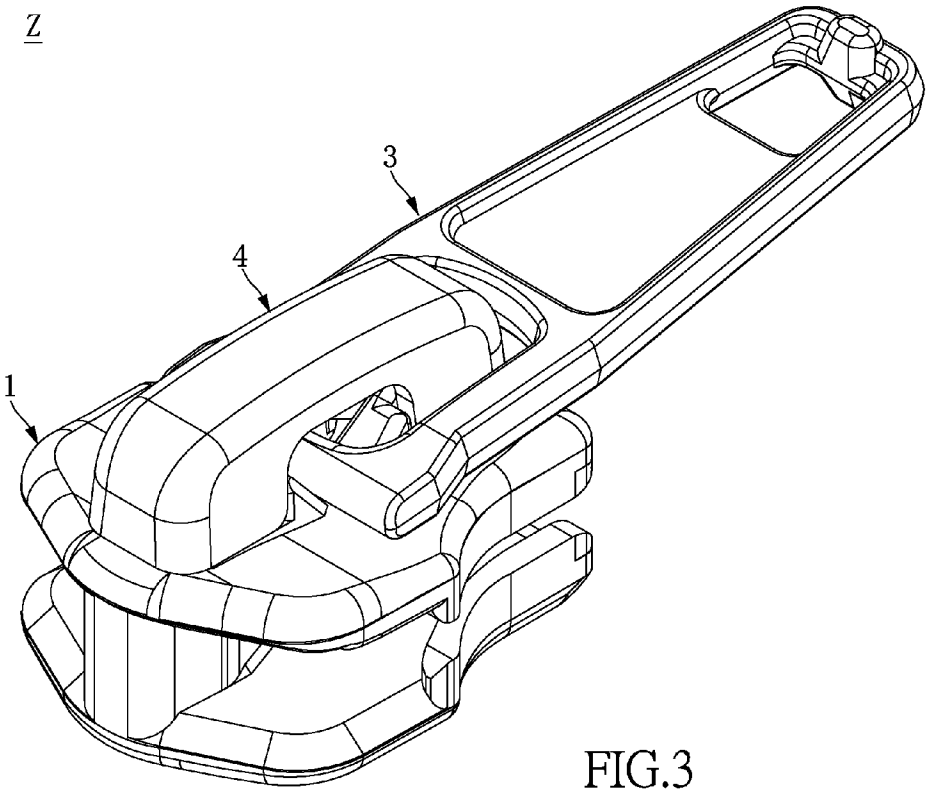
FIG. 3 shows a perspective, assembled, schematic view of the zipper head assembly structure for increasing torsional strength according the instant disclosure.
Figure 4:
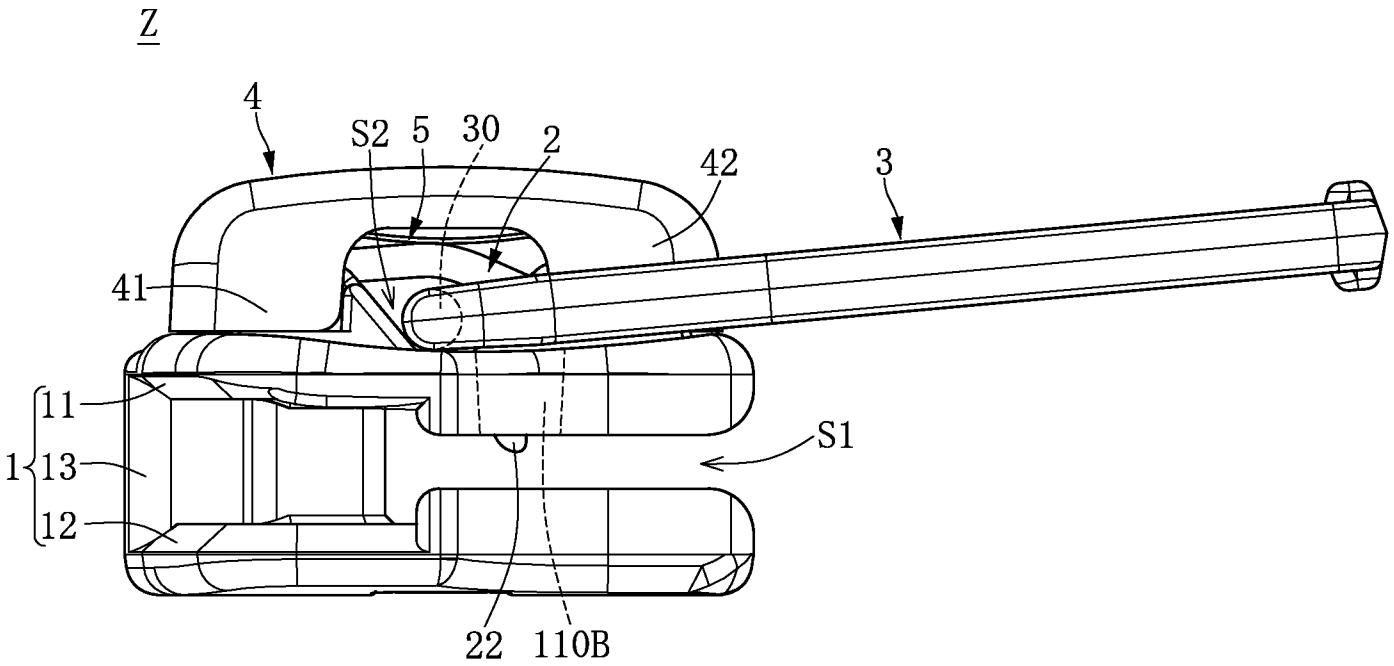
FIG. 4 shows a lateral, assembled, schematic view of the zipper head assembly structure for increasing torsional strength according the instant disclosure.

First, referring to FIG. 1, FIG. 3, and FIG. 4, the sliding member 1 has a first sliding portion 11, a second sliding portion 12 corresponding to the first sliding portion 11, and a connection portion 13 connected between the first sliding portion 11 and the second sliding portion 12. More particularly, the first sliding portion 11 and the second sliding portion 12 are separated from each other, and a first receiving space S1 is formed between the first sliding portion 11 and the second sliding portion 12. In addition, the first sliding portion 11 has a first support body 11A and a second support body 11B corresponding to the first support body 11A, the first support body 11A has a hook groove 110A, and the second support body 11B has a hook hole 110B communicated with the first receiving space S1.

Figure 2:
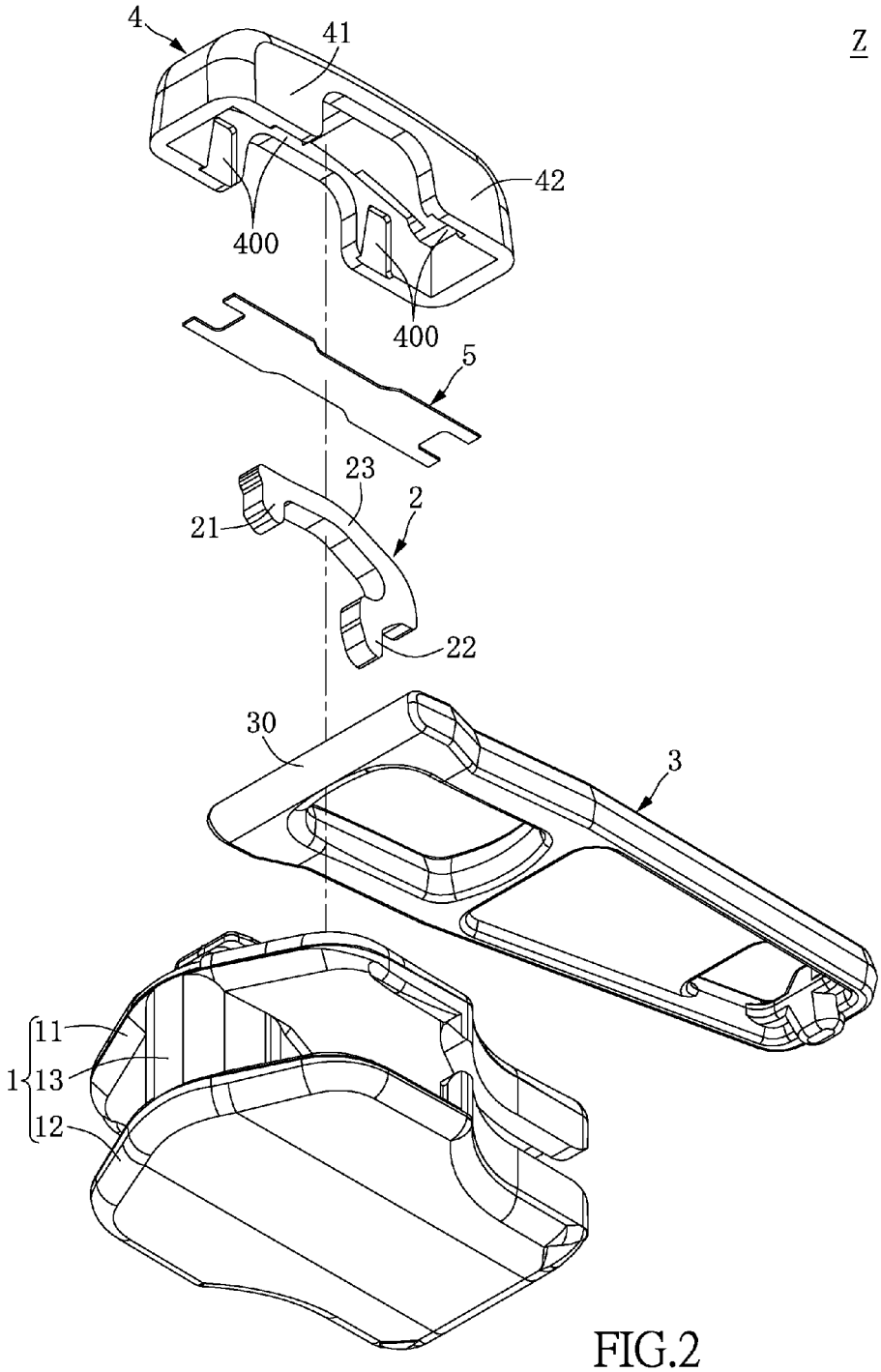
FIG. 2 shows another perspective, exploded, schematic view of the zipper head assembly structure for increasing torsional strength according the instant disclosure.

Moreover, referring to FIG. 1, FIG. 3, and FIG. 4, the locking hook member 2 is movably disposed on the first support body 11A and the second support body 11B. More particularly, the locking hook member 2 has a first end portion 21 disposed inside the hook groove 110A, a second end portion 22 passing through the hook hole 110B, and a contact portion 23 connected between the first end portion 21 and the second end portion 22. In addition, the pull member 3 has a pivot portion 30 disposed on an end side thereof, and the pivot portion 30 of the pull member 3 is movably disposed between the locking hook member 2 and the first sliding portion 11. In addition, the cap body 4 has a first side portion 41 disposed on the first support body 11A and a second side portion 42 opposite to the first side portion 41 and disposed on the second support body 11B, and the cap body 4 is disposed on the first support body 11A and the second support body 11B to cover the locking hook member 2. Moreover, the elastic member 5 is disposed between the inner surface of the cap body 4 and the locking hook member 2, and the cap body 4 has a plurality of concave grooves 400 (as shown in FIG. 2) formed on the inner surface thereof to connect to the bottom-most side of the cap body 4.

More particularly, referring to FIG. 1 and FIG. 4 to FIG. 6, the first sliding portion 11 has an arc-shaped outer surface 110 concaved downwardly from an upper side thereof (that is to say, the substantially middle area of the top surface is lower than the peripheral area of the top surface). A second receiving space S2 is formed between the contact portion 23 of the locking hook member 2 and the arc-shaped outer surface 110 of the first sliding portion 11, and the pivot portion 30 of the pull member 3 is received inside the second receiving space S2. In other words, the second receiving space S2 is increased due to the design of the arc-shaped outer surface 110 that is concaved downwardly from the upper side of the first sliding portion 11, such that the size (such as diameter) of the pivot portion 30 of the pull member 3 is enlarged for increasing the torsional strength of the pull member 3. Hence, the pull member 3 can pass a strict torsion test due to the increased torsional strength of the pull member 3.

More particularly, the arc-shaped outer surface 110 may be composed of a single arc surface (or a single chamber) or a plurality of arc surfaces connected with each other. For example, referring to FIG. 5 and FIG. 6, the arc-shaped outer surface 110 has a first arc face 1101 adjacent to the first support body 11A, a second arc face 1102 adjacent or connected to the second support body 11B, and a third arc face 1103 connected between the first arc face 1101 and the second arc face 1102. In addition, the first arc face 1101 has a first predetermined radius R1, the second arc face 1102 has a second predetermined radius R2, and the third arc face 1103 has a third predetermined radius R3. The first predetermined radius R1 of the first arc face 1101 is smaller than the third predetermined radius R3 of the third arc face 1103, and the third predetermined radius R3 of the third arc face 1103 is smaller than the second predetermined radius R2 of the second arc face 1102.

Figure 5:
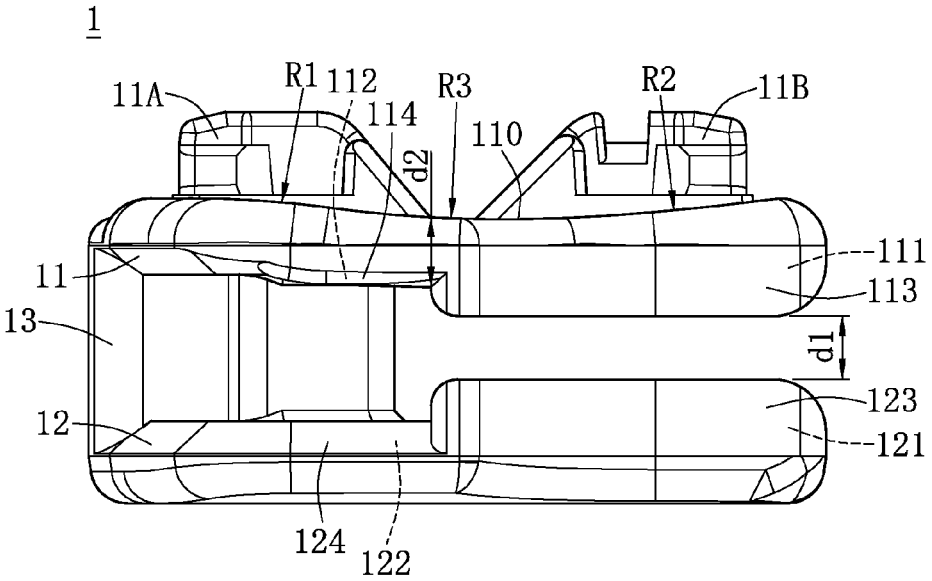
FIG. 5 shows a lateral, schematic view of the sliding member of the zipper head assembly structure for increasing torsional strength according the instant disclosure.
Figure 6:
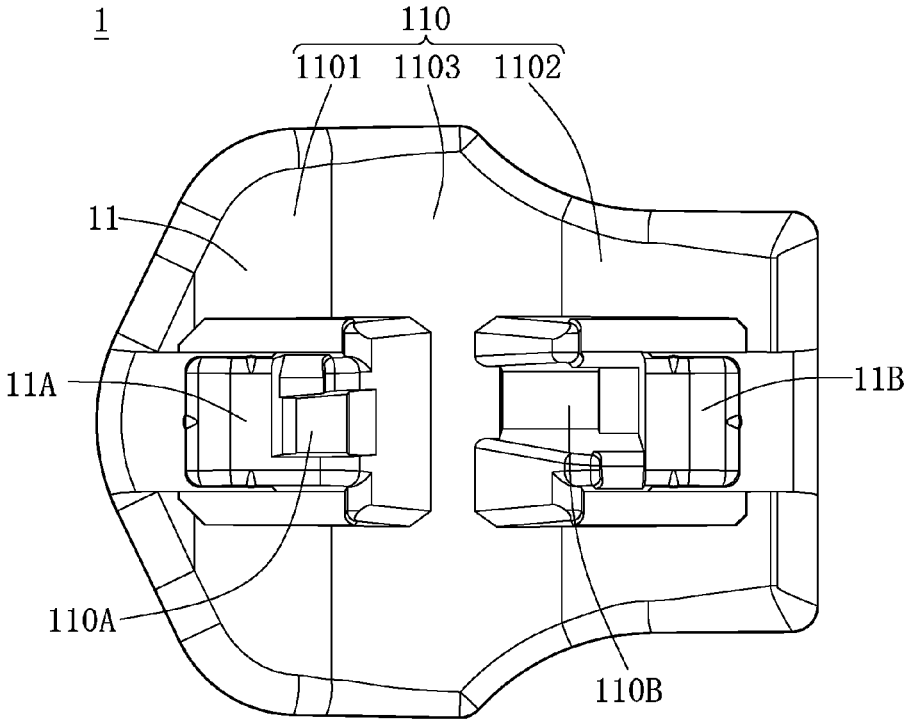
FIG. 6 shows a top, schematic view of the sliding member of the zipper head assembly structure for increasing torsional strength according the instant disclosure.
Figure 7:
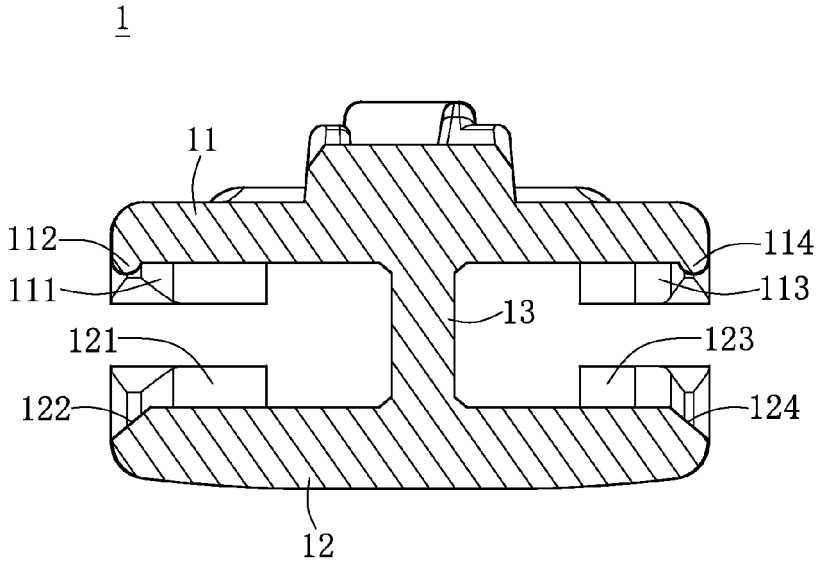
FIG. 7 shows a cross-sectional view taken along the section line A-A of FIG. 1

More particularly, referring to FIG. 1, FIG. 5, and FIG. 7, where FIG. 7 shows a cross-sectional view taken along the section line A-A of FIG. 1. The first sliding portion 11 has a first left side wall portion 111 (or a barrier portion), a left side reinforced rib 112 connected to the first left side wall portion 111, a first right side wall portion 113 corresponding to the first left side wall portion 111, and a right side reinforced rib 114 connected to the first right side wall portion 113 and corresponding to the left side reinforced rib 112. In addition, both the first left side wall portion 111 and the left side reinforced rib 112 are extended along a first predetermined direction from a first side of the first sliding portion 11 to the second sliding portion 12, and both the first right side wall portion 113 and the right side reinforced rib 114 are extended along a second predetermined direction from a second side of the first sliding portion 11 to the second sliding portion 12.

According to the above, the second sliding portion 12 has a second left side wall portion 121 facing the first left side wall portion 111, a left side inclined surface 122 connected to the second left side wall portion 121 and facing the left side reinforced rib 112, a second right side wall portion 123 facing the first right side wall portion 113 and corresponding to the second left side wall portion 121, and a right side inclined surface 124 connected to the second right side wall portion 123 and facing to the right side reinforced rib 114. In addition, the second left side wall portion 121 is extended along a third predetermined direction from a first side of the second sliding portion 12 to the first sliding portion 11, and the second right side wall portion 123 is extended along a fourth predetermined direction from a second side of the second sliding portion 12 to the first sliding portion 11.

It is worth noting that, as shown in FIG. 5, a maximum distance d1 between the first right side wall portion 113 and the second right side wall portion 123 is smaller than a minimum distance d2 between the bottommost side of the right side reinforced rib 114 and the arc-shaped outer surface 110. In addition, a maximum distance d1 (the same as the above mentioned maximum distance d1) between the first left side wall portion 111 (that is shaded by the first right side wall portion 113 and shown as a dotted line) and the second left side wall portion 121 (that is shaded by the second right side wall portion 123 and shown as a dotted line) is smaller than a minimum distance d2 (the same as the above mentioned minimum distance d2) between the bottommost side of the left side reinforced rib 112 (that is shaded by the right side reinforced rib 114 and shown as a dotted line) and the arc-shaped outer surface 110. Hence, the thickness of the first sliding portion 11 is increased due to the left side reinforced rib 112 and the right side reinforced rib 114, such that when many sliding members 1 are concurrently processed by deburring, the design of the left side reinforced rib 112 and the right side reinforced rib 114 for increasing the thickness of the first sliding portion 11 can be used to prevent every two sliding members 1 from biting with each other.

Figure 8:
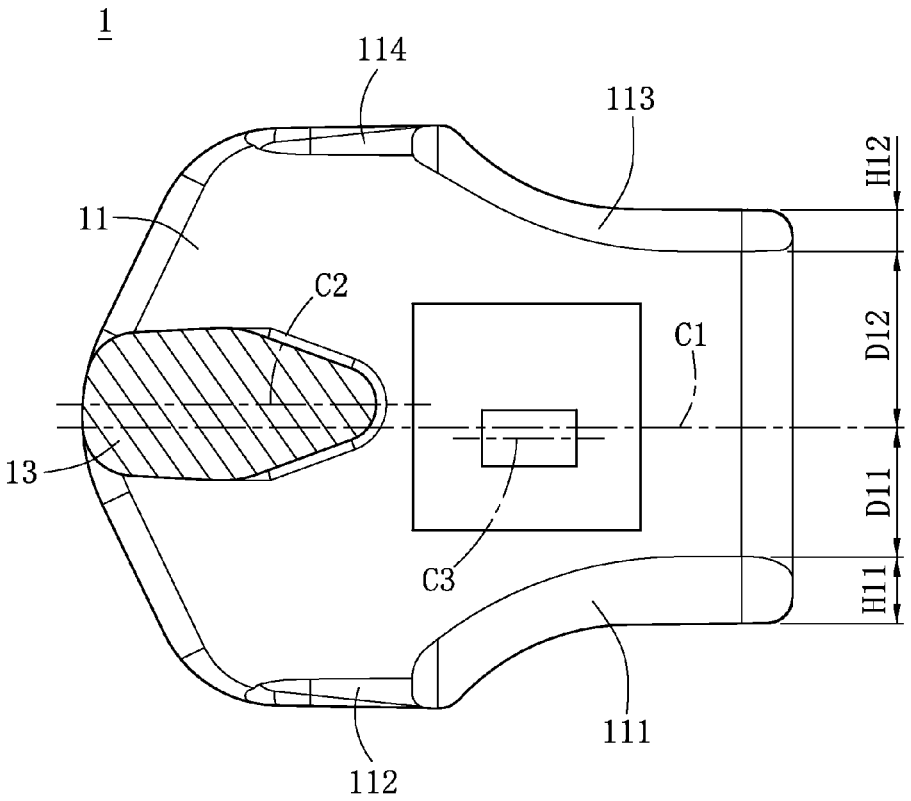
FIG. 8 shows a cross-sectional view taken along the section line B-B of FIG. 1.
Figure 9:
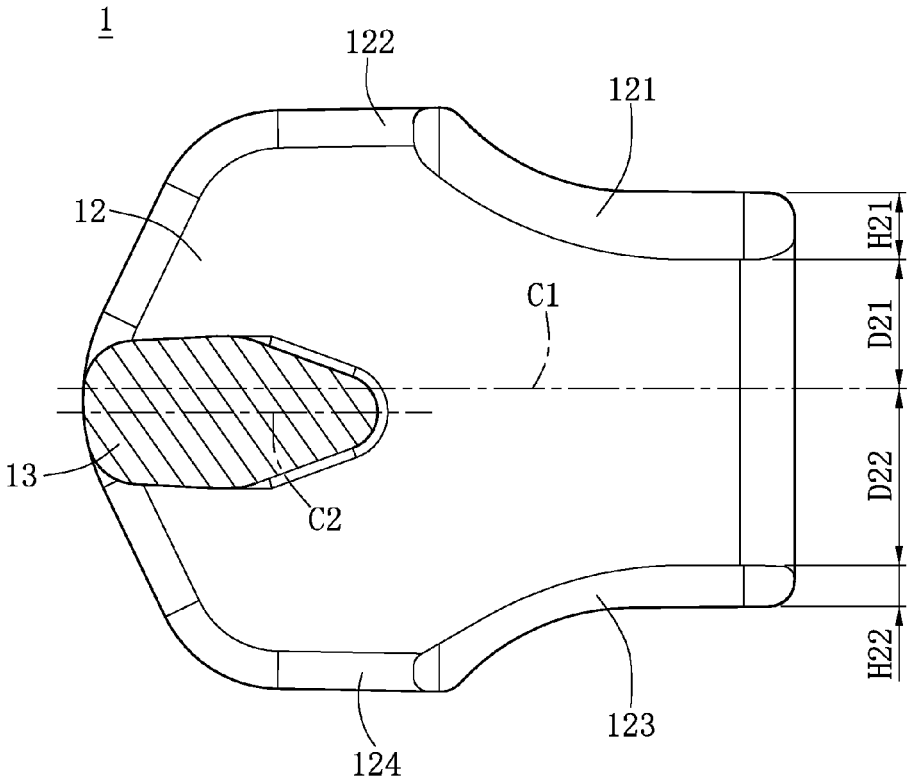
FIG. 9 shows a cross-sectional view taken along the section line C-C of FIG. 1.

Please note, as shown in FIG. 7 to FIG. 9, FIG. 8 shows a cross-sectional view taken along the section line B-B of FIG. 1, and FIG. 9 shows a cross-sectional view taken along the section line C-C of FIG. 1.

First, as shown in FIG. 8, the sliding member 1 has a first central axial line C1, the connection portion 13 of the sliding member 1 has a second central axial line C2, and the hook hole 110B of the second support body 11B has a third central axial line C3. In addition, the second central axial line C2 of the connection portion 13 is horizontally offset by a first predetermined distance and along a first predetermined horizontal direction, and the third central axial line C3 of the hook hole 110B is horizontally offset by a second predetermined distance and along a second predetermined horizontal direction opposite to the fifth predetermined horizontal direction.

More particularly, referring to FIG. 7 and FIG. 8, a first thickness H11 of the first left side wall portion 111 is larger than a second thickness H12 of the first right side wall portion 113, and a first shortest distance D11 between the first left side wall portion 111 to the first central axial line C11 is smaller than a second shortest distance D12 between the first right side wall portion 113 to the first central axial line C1. Referring to FIG. 7 and FIG. 9, a first thickness H21 of the second left side wall portion 121 is larger than a second thickness H22 of the second right side wall portion 123, and a first shortest distance D21 from the second left side wall portion 121 to the first central axial line C1 is smaller than a second shortest distance D22 from the second right side wall portion 123 to the first central axial line C1.

In conclusion, the second receiving space S2 is increased due to the design of the arc-shaped outer surface 110 that is concaved downwardly from the upper side of the first sliding portion 11, such that the size (such as diameter) of the pivot portion 30 of the pull member 3 is enlarged for increasing the torsional strength of the pull member 3. Hence, the pull member 3 can pass a strict torsion test due to the increased torsional strength of the pull member 3.

The aforementioned descriptions merely represent the preferred embodiments of the instant disclosure, without any intention to limit the scope of the instant disclosure which is fully described only within the following claims. Various equivalent changes, alterations or modifications based on the claims of the instant disclosure are all, consequently, viewed as being embraced by the scope of the instant disclosure.

What is claimed is:

1. A zipper head assembly structure for increasing torsional strength, comprising:

a sliding member having a first sliding portion, a second sliding portion corresponding to the first sliding portion, and a connection portion connected between the first sliding portion and the second sliding portion, wherein a first receiving space is formed between the first sliding portion and the second sliding portion, the first sliding portion has a first support body and a second support body corresponding to the first support body, the first support body has a hook groove, and the second support body has a hook hole communicated with the first receiving space;

a locking hook member movably disposed on the first support body and the second support body, wherein the locking hook member has a first end portion disposed inside the hook groove, a second end portion passing through the hook hole, and a contact portion connected between the first end portion and the second end portion;

a pull member having a pivot portion disposed on an end side thereof, wherein the pivot portion of the pull member is movably disposed between the locking hook member and the first sliding portion;

a cap body having a first side portion disposed on the first support body and a second side portion opposite to the first side portion and disposed on the second support body; and an elastic member disposed between the inner surface of the cap body and the locking hook member;

wherein the first sliding portion has an arc-shaped outer surface concaved downwardly from an upper side thereof, a second receiving space is formed between the contact portion of the locking hook member and the arc-shaped outer surface of the first sliding portion, and the pivot portion of the pull member is received inside the second receiving space;

wherein the first sliding portion has a first left side wall portion, a left side reinforced rib connected to the first left side wall portion, a first right side wall portion corresponding to the first left side wall portion, and a right side reinforced rib connected to the first right side wall portion and corresponding to the left side reinforced rib, the first left side wall portion and the left side reinforced rib are extended along a first predetermined direction from a first side of the first sliding portion to the second sliding portion, and the first right side wall portion and the right side reinforced rib are extended along a second predetermined direction from a second side of the first sliding portion to the second sliding portion;

wherein the second sliding portion has a second left side wall portion facing the first left side wall portion, a left side inclined surface connected to the second left side wall portion and facing the left side reinforced rib, a second right side wall portion facing the first right side wall portion and corresponding to the second left side wall portion, and a right side inclined surface connected to the second right side wall portion and facing to the right side reinforced rib, the second left side wall portion is extended along a third predetermined direction from a first side of the second sliding portion to the first sliding portion, and the second right side wall portion is extended along a fourth predetermined direction from a second side of the second sliding portion to the first sliding portion.

2. The zipper head assembly structure of claim 1, wherein the arc-shaped outer surface has a first arc face adjacent to the first support body, a second arc face adjacent to the second support body, and a third arc face connected between the first arc face and the second arc face, wherein the first arc face has a first predetermined radius, the second arc face has a second predetermined radius, the third arc face has a third predetermined radius, the first predetermined radius of the first arc face is smaller than the third predetermined radius of the third arc face, and the third predetermined radius of the third arc face is smaller than the second predetermined radius of the second arc face, wherein a maximum distance between the first left side wall portion and the second left side wall portion is smaller than a minimum distance between the bottommost side of the left side reinforced rib and the arc-shaped outer surface, and a maximum distance between the first right side wall portion and the second right side wall portion is smaller than a minimum distance between the bottommost side of the right side reinforced rib and the arc-shaped outer surface.

3. The zipper head assembly structure of claim 1, wherein the sliding member has a first central axial line, the connection portion of the sliding member has a second central axial line, and the hook hole of the second support body has a third central axial line, the second central axial line is horizontally offset by a first predetermined distance and along a first predetermined horizontal direction, and the third central axial line of the hook hole is horizontally offset by a second predetermined distance and along a second predetermined horizontal direction opposite to the fifth predetermined horizontal direction, wherein a thickness of the first left side wall portion is larger than a thickness of the first right side wall portion, and a shortest distance between the first left side wall portion to the first central axial line is smaller than a shortest distance between the first right side wall portion to the first central axial line, wherein a thickness of the second left side wall portion is larger than a thickness of the second right side wall portion, and a shortest distance from the second left side wall portion to the first central axial line is smaller than a shortest distance from the second right side wall portion to the first central axial line.

4. A zipper head assembly structure for increasing torsional strength, comprising:

a sliding member having a first sliding portion, a second sliding portion corresponding to the first sliding portion, and a connection portion connected between the first sliding portion and the second sliding portion, wherein the first sliding portion has a first support body and a second support body corresponding to the first support body, and the first sliding portion has an arc-shaped outer surface concaved downwardly from an upper side thereof;

a locking hook member movably disposed on the first support body and the second support body;

a pull member having a pivot portion disposed on an end side thereof, wherein the pivot portion of the pull member is movably disposed between the locking hook member and the arc-shaped outer surface of the first sliding portion;

a cap body disposed on the first support body and the second support body to cover the locking hook member; and an elastic member disposed between the inner surface of the cap body and the locking hook member;

wherein the first sliding portion has a first left side wall portion, a left side reinforced rib connected to the first left side wall portion, a first right side wall portion corresponding to the first left side wall portion, and a right side reinforced rib connected to the first right side wall portion and corresponding to the left side reinforced rib, the first left side wall portion and the left side reinforced rib are extended along a first predetermined direction from a first side of the first sliding portion to the second sliding portion, and the first right side wall portion and the right side reinforced rib are extended along a second predetermined direction from a second side of the first sliding portion to the second sliding portion.

5. The zipper head assembly structure of claim 4, wherein the second sliding portion has a second left side wall portion facing the first left side wall portion, a left side inclined surface connected to the second left side wall portion and facing the left side reinforced rib, a second right side wall portion facing the first right side wall portion and corresponding to the second left side wall portion, and a right side inclined surface connected to the second right side wall portion and facing to the right side reinforced rib, the second left side wall portion is extended along a third predetermined direction from a first side of the second sliding portion to the first sliding portion, and the second right side wall portion is extended along a fourth predetermined direction from a second side of the second sliding portion to the first sliding portion.

6. The zipper head assembly structure of claim 5, wherein the arc-shaped outer surface has a first arc face adjacent to the first support body, a second arc face adjacent to the second support body, and a third arc face connected between the first arc face and the second arc face, wherein the first arc face has a first predetermined radius, the second arc face has a second predetermined radius, the third arc face has a third predetermined radius, the first predetermined radius of the first arc face is smaller than the third predetermined radius of the third arc face, and the third predetermined radius of the third arc face is smaller than the second predetermined radius of the second arc face, wherein a maximum distance between the first left side wall portion and the second left side wall portion is smaller than a minimum distance between the bottommost side of the left side reinforced rib and the arc-shaped outer surface, and a maximum distance between the first right side wall portion and the second right side wall portion is smaller than a minimum distance between the bottommost side of the right side reinforced rib and the arc-shaped outer surface.

7. The zipper head assembly structure of claim 4, wherein the sliding member has a first central axial line, the connection portion of the sliding member has a second central axial line, and the hook hole of the second support body has a third central axial line, the second central axial line is horizontally offset by a first predetermined distance and along a first predetermined horizontal direction, and the third central axial line of the hook hole is horizontally offset by a second predetermined distance and along a second predetermined horizontal direction opposite to the fifth predetermined horizontal direction, wherein a thickness of the first left side wall portion is larger than a thickness of the first right side wall portion, and a shortest distance between the first left side wall portion to the first central axial line is smaller than a shortest distance between the first right side wall portion to the first central axial line, wherein a thickness of the second left side wall portion is larger than a thickness of the second right side wall portion, and a shortest distance from the second left side wall portion to the first central axial line is smaller than a shortest distance from the second right side wall portion to the first central axial line.

8. A sliding member, comprising:

a first sliding portion;

a second sliding portion corresponding to the first sliding portion; and a connection portion connected between the first sliding portion and the second sliding portion, wherein the first sliding portion has a first support body and a second support body corresponding to the first support body, and the first sliding portion has an arc-shaped outer surface concaved downwardly from an upper side thereof;

wherein the first sliding portion has a first left side wall portion, a left side reinforced rib connected to the first left side wall portion, a first right side wall portion corresponding to the first left side wall portion, and a right side reinforced rib connected to the first right side wall portion and corresponding to the left side reinforced rib, the first left side wall portion and the left side reinforced rib are extended along a first predetermined direction from a first side of the first sliding portion to the second sliding portion, and the first right side wall portion and the right side reinforced rib are extended along a second predetermined direction from a second side of the first sliding portion to the second sliding portion.

9. The sliding member of claim 8, wherein the second sliding portion has a second left side wall portion facing the first left side wall portion, a left side inclined surface connected to the second left side wall portion and facing the left side reinforced rib, a second right side wall portion facing the first right side wall portion and corresponding to the second left side wall portion, and a right side inclined surface connected to the second right side wall portion and facing to the right side reinforced rib, the second left side wall portion is extended along a third predetermined direction from a first side of the second sliding portion to the first sliding portion, and the second right side wall portion is extended along a fourth predetermined direction from a second side of the second sliding portion to the first sliding portion.

10. The sliding member of claim 9, wherein the arc-shaped outer surface has a first arc face adjacent to the first support body, a second arc face adjacent to the second support body, and a third arc face connected between the first arc face and the second arc face, wherein the first arc face has a first predetermined radius, the second arc face has a second predetermined radius, the third arc face has a third predetermined radius, the first predetermined radius of the first arc face is smaller than the third predetermined radius of the third arc face, and the third predetermined radius of the third arc face is smaller than the second predetermined radius of the second arc face, wherein a maximum distance between the first left side wall portion and the second left side wall portion is smaller than a minimum distance between the bottommost side of the left side reinforced rib and the arc-shaped outer surface, and a maximum distance between the first right side wall portion and the second right side wall portion is smaller than a minimum distance between the bottommost side of the right side reinforced rib and the arc-shaped outer surface.

* * * * *